United States Patent [19]

Yoshikawa

[11] Patent Number: 4,572,117

[45] Date of Patent: Feb. 25, 1986

[54] VALVE ARRANGEMENT FOR AN INTERNAL COMBUSTION ENGINE

[75] Inventor: Masaaki Yoshikawa, Iwata, Japan

[73] Assignee: Yamaha Hatsukoki Kabushiki Kaisha, Iwata, Japan

[21] Appl. No.: 712,017

[22] Filed: Mar. 14, 1985

[30] Foreign Application Priority Data

Mar. 15, 1984 [JP] Japan ..... 559-49898

[51] Int. Cl.[4] ..... F01L 3/10; F02B 31/02

[52] U.S. Cl. ..... 123/90.65; 123/188 SC; 123/308; 123/315; 251/337

[58] Field of Search ..... 123/90.65, 188 SC, 90.66, 123/308, 315; 251/337

[56] References Cited

U.S. PATENT DOCUMENTS

| | | | |
|---|---|---|---|
| 1,815,612 | 7/1931 | Cataline et al. | 251/337 |
| 3,456,684 | 7/1969 | Sochting | 251/337 |
| 3,938,542 | 2/1976 | Bolha | 251/337 |
| 4,509,473 | 4/1985 | Hampariha | 123/188 SC |

*Primary Examiner*—Ira S. Lazarus

*Attorney, Agent, or Firm*—Ernest A. Beutler

[57] ABSTRACT

A valve train for an internal combustion engine embodying an improved valve spring arrangement that permits a compact valve placement. The valve springs are disposed so that they are non-circular in planes perpendicular to the axis of the associated valve stem and are disposed with a long axis and a short axis. The long axes of the respective springs extend parallel to each other so as to facilitate the close placement of the valves.

10 Claims, 4 Drawing Figures

VALVE ARRANGEMENT FOR AN INTERNAL COMBUSTION ENGINE

BACKGROUND OF THE INVENTION

This invention relates to a valve arrangement for an internal combustion engine and more particularly to an improved valve spring arrangement that permits a compact valve orientation and the use of multiple valves per combustion chamber.

The advantages of the use of multiple valves for a single combustion chamber of an internal combustion engine has been well known. Recently, many engines employed in automotive applications employ four valves per cylinder, two intake and two exhaust. Even further advantages may be enjoyed if three intake valves are used for each cylinder of the engine. However, with the trend toward relatively small displacement engines, the positioning of three intake valves or plural valves, for that matter, in a single cylinder gives rise to a number of problems. For example, it is desirable to provide a compact arrangement and one in which the combustion chamber is relatively small so as to maintain the desired compression ratio. The trend toward higher engine speeds, however, requires the use of sufficient valve spring force so as to insure full closure of the valves even at high speeds. With conventional valve spring arrangements, however, the size of the spring itself has somewhat restricted the valve placement.

It is, therefore, a principal object of this invention to porovide an improved arrangement for the valves of an internal combustion engine.

It is another object of this invention to provide a compact valve arrangement for an engine that permits the use of multiple valves.

It is a yet further object of this invention to provide a valve spring arrangement for internal combustion engines which provides sufficient force for the valve and yet which permits a compact configuration.

SUMMARY OF THE INVENTION

This invention is adapted to be embodied in an internal combustion engine that has components which define a combustion chamber and a pair of poppet type valves for controlling the communication with the chamber. The valves have their heads and stems positioned in close proximity and springs act on each of the valve stems for urging the valves toward their closed positions. In accordance with the invention, the valve springs have their coils arranged to have long and short axes in planes perpendicular to the stem of the valves with the long axes of the springs of the respective valves being in parallel planes.

DETAILED DESCRIPTION OF THE PREFERRED EMBODIMENTS

Figure 1:
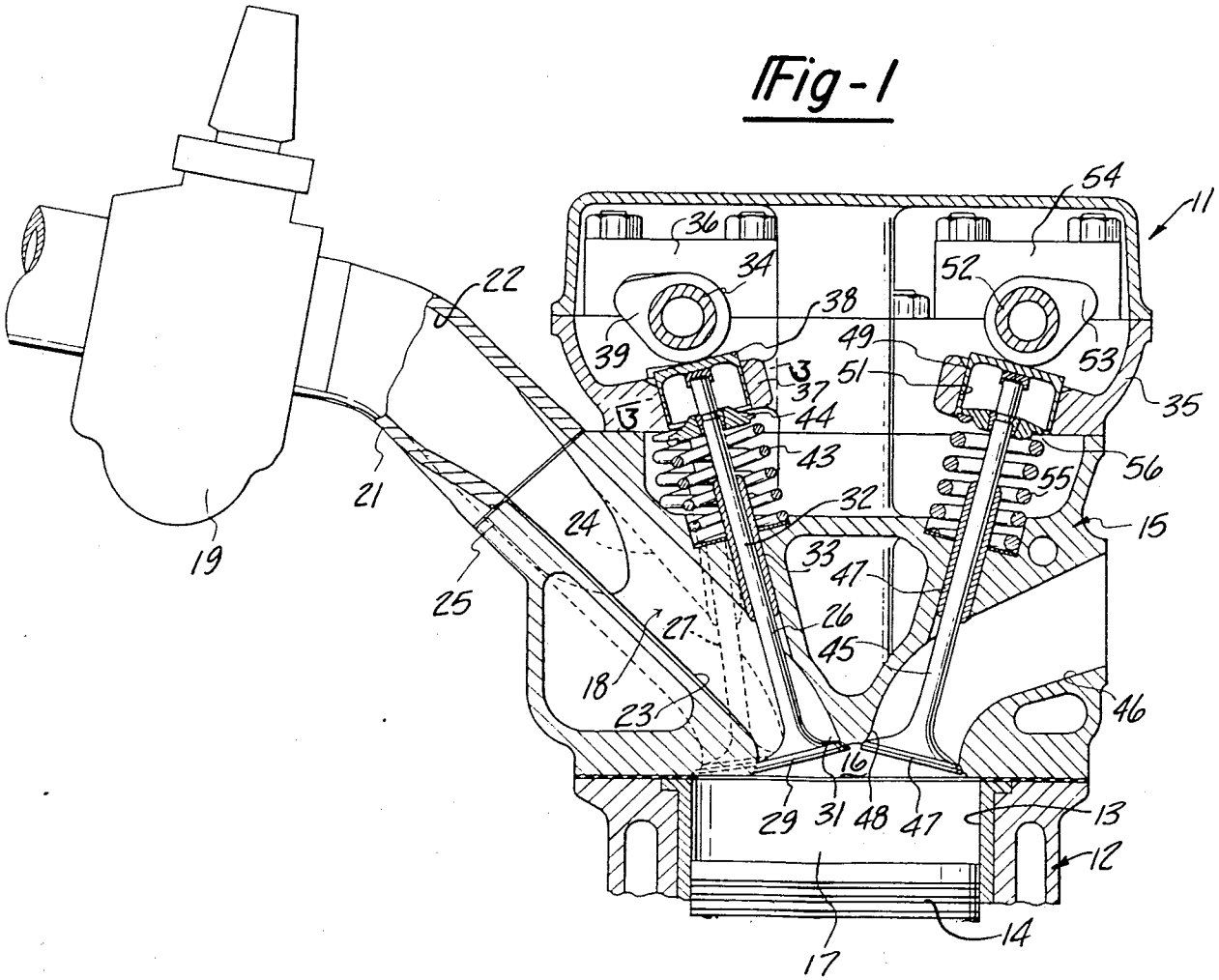
FIG. 1 is a side elevational view, with portions shown in cross-section, of a portion of an internal combustion engine constructed in accordance with a first embodiment of the invention.
Figure 2:
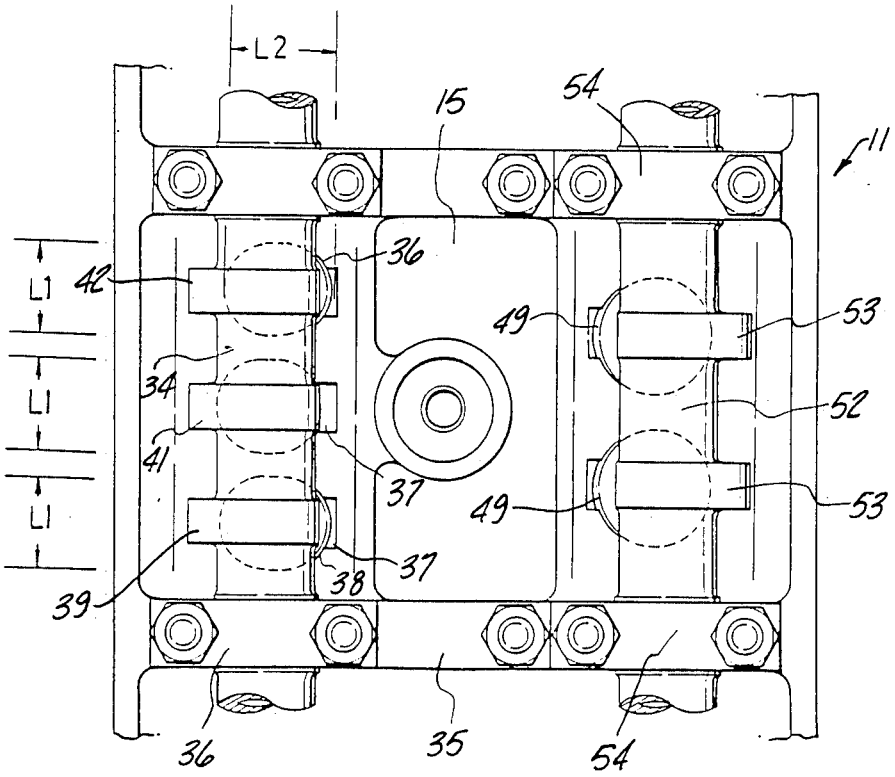
FIG. 2 is a top plan view showing the camshaft arrangement of the engine with the cam cover removed.
Figure 3:
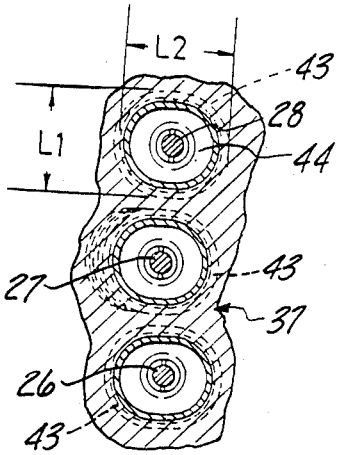
FIG. 3 is a cross-sectional view taken along the line 3—3 of FIG. 1.

Referring first to FIGS. 1 through 3, a portion of an internal combustion engine constructed in accordance with a first embodiment of the invention is identified generally by the reference numeral 11. FIG. 1 is a partial cross-sectional view taken through a single cylinder of the engine, which in the illustrated embodiment is of the inline type. Only the valve train portion of the engine and some associated components have been illustrated since this is the area wherein the invention resides. Although a single cylinder of an inline type engine is shown, it should be readily apparent to those skilled in the art that the invention may be used in conjunction with engines of other configurations such as V type, opposed, multiple cylinder or single cylinder engines.

The engine 11 includes a cylinder block, indicated generally by the reference numeral 12 and only shown partially, in which a cylinder bore 13 is formed. A piston 14 reciprocates within the cylinder bore 13 and drives a crankshaft (not shown) in a known manner.

A cylinder head, indicated generally by the reference numeral 15, is affixed to the cylinder block 12 and has a cavity 16 formed that cooperates with each of the cylinder bores 13 so as to provide a varying volume chamber 17 which includes the cavity 16 and the area in the cylinder bore 13 above the piston 14.

Induction passage means, indicated generally by the reference numeral 18, are provided for delivering a fuel/air charge formed by a carburetor 19 that discharges into a manifold 21 to the combustion chambers 17. The manifold 21 is formed with a single induction passage 22 that merges into three portions 23, 24 and 25, each of which extend through the cylinder head 15 and terminate in the cavity 17. Respective intake valves 26, 27 and 28 control the flow through the passages 23, 24, and 25.

Each of the intake valves 26, 27 and 28 has the same general construction and only the valve 26 appears in full lines in FIG. 1. Because of their generally similar construction, only the parts of the valve 26 will be described in detail because it is believed that those skilled in the art will understand the construction of the remaining valves. Each valve 26, 27 and 28 is of the poppet type and includes a head portion 29 that cooperates with a valve seat 31 so as to control the flow through its respective passages 23, 24 or 25. The valves also include stem portions 32 that are slidably supported in guides 33 pressed into the cylinder head 15.

In accordance with a form of the invention, the valves 26 and 28 may have their respective stems 32 extending parallel to each other and at a greater angle to the axis of the cylinder bore 13 than the stem of the remaining valve 27. The valve stems, however, all intersect at the same point which is coincident with the axis of rotation of a camshaft 34, for a reason to be described. Reference may be had to the copending application entitled "Four-Cycle Engine", Ser. No. 369,665, filed Apr. 19, 1982, in the name of Masaaki Yoshikawa, and assigned to the assignee of this application for more details as to the specific orientation of the valves.

A cam tower 35 is affixed to the upper side of the cylinder head 15 and has affixed to it one or more bearing blocks 36 that journal the camshaft 34 for its rotation about the aforenoted axis. In addition, bores 37 formed in the cam tower slidably support tappet followers 38 that are actuated by respective lobes 39, 41 and 42 of the camshaft 34 for operating the valves 26, 27 and 28, respectively.

As is well known, coil springs are employed for urging the valves 26, 27 and 28 toward their closed positions. However, in accordance with the invention, the coil springs used for this purpose do not have circular coils. Rather, they have coils that are oval or elliptical shape as best seen in FIG. 3. The springs associated with each valve are identical in construction and thus only one of them will be described. The valve springs, indicated by the reference numeral 43, as have been noted have an elliptical or oval shape having a long axis L2 and a short axis L1. In order to permit the valves 26, 27 and 28 to be positioned closely adjacent each other and in the orientation aforedescribed, the long axes L2 are disposed parallel to each other while the short axes L1 extend generally in the same line. However, since the valve 27 is not parallel to the valves 26 and 28, these are not truly perpendicular but only in a general sense are they perpendicular. It should be readily apparent from FIG. 3 that this orientation of the valve springs permits them to be positioned much closer while retaining a high spring force than with prior art type of constructions using circular cross-section springs.

A combined valve spring retainer and keeper assembly 44 is positioned at the upper end of each valve stem for loading the springs 43 and for holding them and the valves 26, 27 and 28 in place, as is well known in this art.

On the side of the cylinder head opposite to the intake valves 26, 27 and 28 are provided exhaust valves 45 that control flow through respective exhaust passages 46 formed in the cylinder head 15. The exhaust valves 45 are of the poppet type and each includes a respective head 47 that cooperates with an exhaust port or valve seat 48 so as to control the flow through the exhaust passages 46. In addition, the valves 45 have stems that are slidably supported in valve guides 47 pressed into the cylinder head assembly 15.

The exhaust valves 45 are operated by thimble tappets 49 that are supported in bores 51 formed in the valve box 35. An overhead mounted exhaust camshaft 52 having lobes 53 is provided for opening the exhaust valves 45. The exhaust camshaft 52 is journaled in the cam box 35 and by bearing caps 54 that are affixed to the cam box 35 in a suitable manner. Conventional cylindrical coil springs 55 operate against valve keepers 56 so as to urge the exhaust valves 45 to their closed position.

In the illustrated embodiment, there are only two exhaust valves per cylinder and therefore it is not necessary to utilize the specially formed springs as with the intake valves 26, 27 and 28 (valve springs 43). It is to be understood, however, that it is possible to employ more valves and utilize such springs so as to permit the same close placement.

Figure 4:
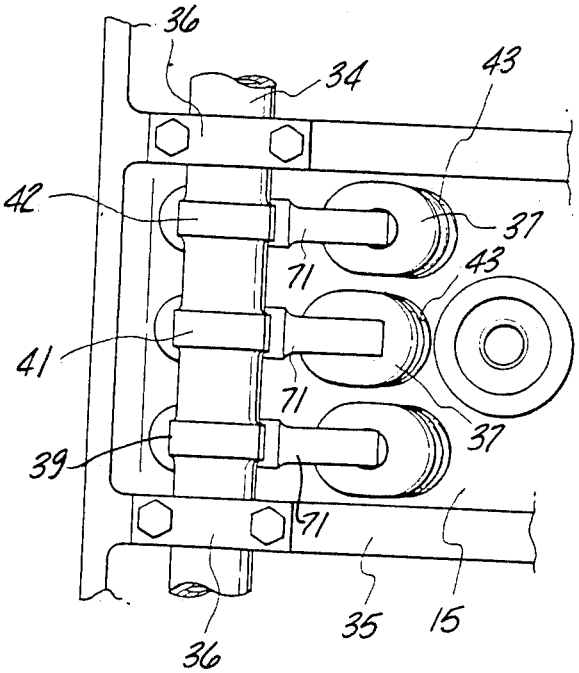
FIG. 4 is a partial top plan view, in part similar to FIG. 2, showing another embodiment of the invention.

In the embodiment of FIGS. 1 through 3, the valves, and specifically the intake valves 26, 27 and 28, were directly actuated by the cam lobes 39, 41 and 42. It should be readily apparent, however, that the invention may be used in conjunction with engines wherein the valves are operated through rocker arms and such an arrangement is shown in FIG. 4, wherein only the construction associated with the intake valves is illustrated. Since the only difference between this embodiment and that of FIGS. 1 through 3 is the use of the rocker arms, all other components have been illustrated by the same reference numerals and their description will not be repeated. In this embodiment, respective rocker arms 71 are interposed between the cam lobes 39, 41 and 42 and the tips of the valves. In this embodiment, the tappet followers are not required since the rocker arms 71 may directly engage the valve tips. The rocker arms 71 may be suitably supported for pivotal movement relative to the cylinder head by means including hydraulic adjusters of a known type. In other regards, this embodiment is the same as the embodiment previously described and further description of this embodiment is not believed to be necessary for that reason.

In view of the foregoing description, it is believed readily apparent that those skilled in the art will understand that the unique valve spring arrangement employed will permit the use of a large number of valves per cylinder with a very compact and close arrangement of the valves without adversely affecting the valve spring load. Although two embodiments of the invention have been illustrated and described, it is believed that those skilled in the art will readily understand that the invention is susceptible of various changes and modifications, without departing from the spirit and scope of the invention, as defined by the appended claims.

I claim:

1. In an internal combustion engine comprising components defining a combustion chamber and a pair of poppet type valves for controlling the communication with said combustion chamber, said valves having their heads and stems positioned in close proximity, the improvement comprising coil springs each acting on a respective one of said valve stems for urging said valves to their closed position, said valve springs having their coils arranged to have a long axis and a short axis in planes perpendicular to the stems of said valves with the long axes of said springs of the respective valves being in parallel planes.

2. In an internal combustion engine as set forth in claim 1 wherein one of the components comprises a cylinder head and the valves are slidably supported and control flow through ports in the cylinder head.

3. In an internal combustion engine as set forth in claim 2 wherein the valves serve the same function.

4. In an internal combustion engine as set forth in claim 3 further including a third valve forming the same function and having a similarly shaped spring, said three valves comprising intake valves and further including a pair of exhaust valves for controlling the flow of exhaust gases from the combustion chamber.

5. In an internal combustion engine as set forth in claim 4 wherein there are coil spring means associated with the exhaust valves and said coil springs have a round configuration in planes perpendicular to the axis of the stems of the exhaust valves.

6. In an internal combustion engine as set forth in claim 2 wherein the valves are disposed at a different angle to each other.

7. In an internal combustion engine as set forth in claim 6 wherein the valves stems intersect at the same point.

8. In an internal combustion engine as set forth in claim 7 wherein the valves serve the same function.

9. In an internal combustion engine as set forth in claim 8 further including a third valve forming the same function and having a similarly shaped spring, said three valves comprising intake valves and further including a pair of exhaust valves for controlling the flow of exhaust gases from the combustion chamber.

10. In an internal combustion engine as set forth in claim 9 wherein there are coil spring means associated with the exhaust valves and said coil springs have a round configuration in planes perpendicular to the axis of the stems of the exhaust valves.

* * * * *